US006881157B2

(12) United States Patent
Hsien

(10) Patent No.: US 6,881,157 B2
(45) Date of Patent: Apr. 19, 2005

(54) GOLF CLUB HAVING STABILIZED AIR FLOW STRUCTURE

(76) Inventor: Chih-Ching Hsien, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/732,856

(22) Filed: Dec. 11, 2003

(65) Prior Publication Data

US 2004/0121851 A1 Jun. 24, 2004

Related U.S. Application Data

(62) Division of application No. 10/298,401, filed on Nov. 15, 2002, now abandoned.

(51) Int. Cl.[7] ..... A63B 53/10; A63B 53/12

(52) U.S. Cl. ..... 473/317; 473/323

(58) Field of Search ..... 473/316–323; 428/36.3, 36.9; 264/635; 156/187–188; D21/757; 280/819; 43/18.1 R, 18.5

(56) References Cited

U.S. PATENT DOCUMENTS 1,528,017 A * 3/1925 Gammeter ..... 473/327
2,250,429 A * 7/1941 Vickery ..... 473/323
5,251,896 A * 10/1993 Gerlach ..... 473/317
5,545,094 A * 8/1996 Hsu ..... 473/317
5,632,692 A * 5/1997 Lebovici ..... 473/317
5,795,244 A * 8/1998 Lu ..... 473/317
5,873,793 A * 2/1999 Swinford ..... 473/317
5,913,733 A * 6/1999 Bamber ..... 473/317
6,027,414 A * 2/2000 Koebler ..... 473/228
D436,138 S * 1/2001 Chiasson ..... D21/757
2003/0162599 A1 * 8/2003 Klein ..... 473/251

* cited by examiner

*Primary Examiner*—Stephen Blau

(57) ABSTRACT

A golf club comprises a handgrip; a club head, and a club body between the first end and the second end. A cross section area of the club body includes a front portion having a first and a second including surfaces that define a front cusp in front of said first and said second inclined surfaces; a rear portion having a third and a fourth inclined surface that define a rear cusp at a rear connecting end of the third and fourth surfaces; and a middle section being curved inwards. In a direction from the handgrip to the club head, the club body has at least one reduced segment having a smaller size than other portion thereof, and a shoulder is formed between each reduced segment and an adjacent other portion of the golf club.

1 Claim, 6 Drawing Sheets

GOLF CLUB HAVING STABILIZED AIR FLOW STRUCTURE

The present invention is a divisional application of the U.S. patent Ser. No. 10/298,401 filed on Nov. 15, 2002, now abandoned which is assigned to the inventor of the present invention and thus the content of U.S. patent Ser. No. 10/298,401 is incorporated into the present invention, as a part of this specification. This invention claims one species in U.S. patent Ser. No. 10/298,401.

BACKGROUND OF THE INVENTION

1. Field of the Invention

The present invention relates to golf clubs, and more particularly to a golf club having a stabilized airflow or aerodynamic structure.

2. Description of the Prior Art

Typical golf clubs normally comprise a club body having a circular cross section, or oval cross section. However, as striking golf balls with the golf club, eddy currents may be generated in the rear portion of the golf club, such that the golf club may not be precisely directed to a predetermined direction, and the golf balls thus may not be precisely stricken toward the predetermined direction and position.

The present invention has arisen to mitigate and/or obviate the afore-described disadvantages of the conventional golf clubs.

SUMMARY OF THE INVENTION

The primary objective of the present invention is to provide a golf club including a stabilized airflow or aerodynamic structure for allowing the golf club to be precisely directed toward the predetermined direction, and for allowing the golf balls to be precisely stricken toward the predetermined direction and position.

In accordance with one aspect of the invention, there is provided a golf club which comprises a first end having a hand grip; a second end having a club head, and a club body between the first end and the second end. A cross section area of the club body includes a front portion having a first and a second including surfaces that define a front cusp in front of said first and said second inclined surfaces; a rear portion having a third inclined surface and a fourth inclined surface that define a rear cusp at a rear connecting end of the third and fourth surfaces; and a middle section being curved inwards. In a direction from the first end to the second end, the club body has at least one reduced segment having a smaller size than other portion thereof, and a shoulder is formed between each reduced segment and an adjacent other portion of the golf club.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
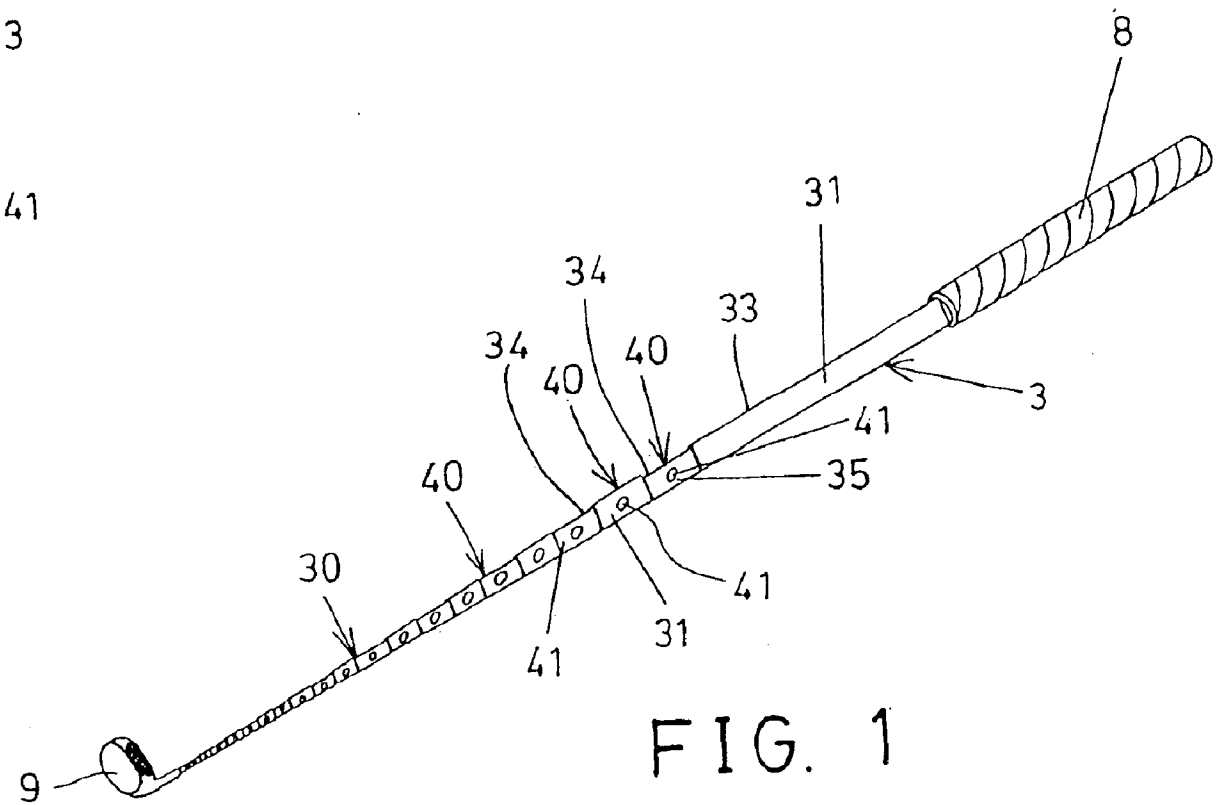
FIG. 1 is a perspective view of a golf club in accordance with the present invention.
Figure 2:
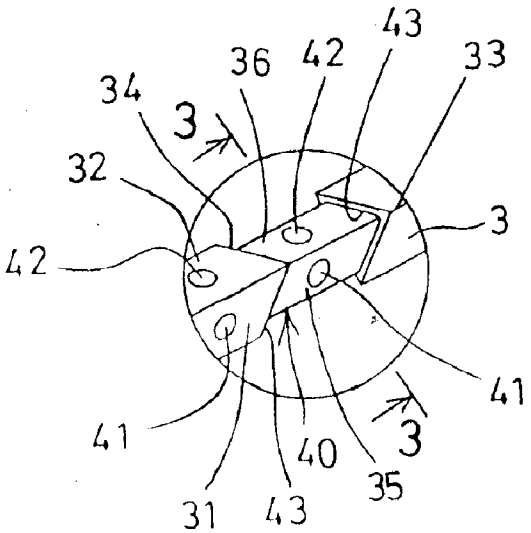
FIG. 2 is an enlarged partial perspective view of the golf club.
Figure 3:
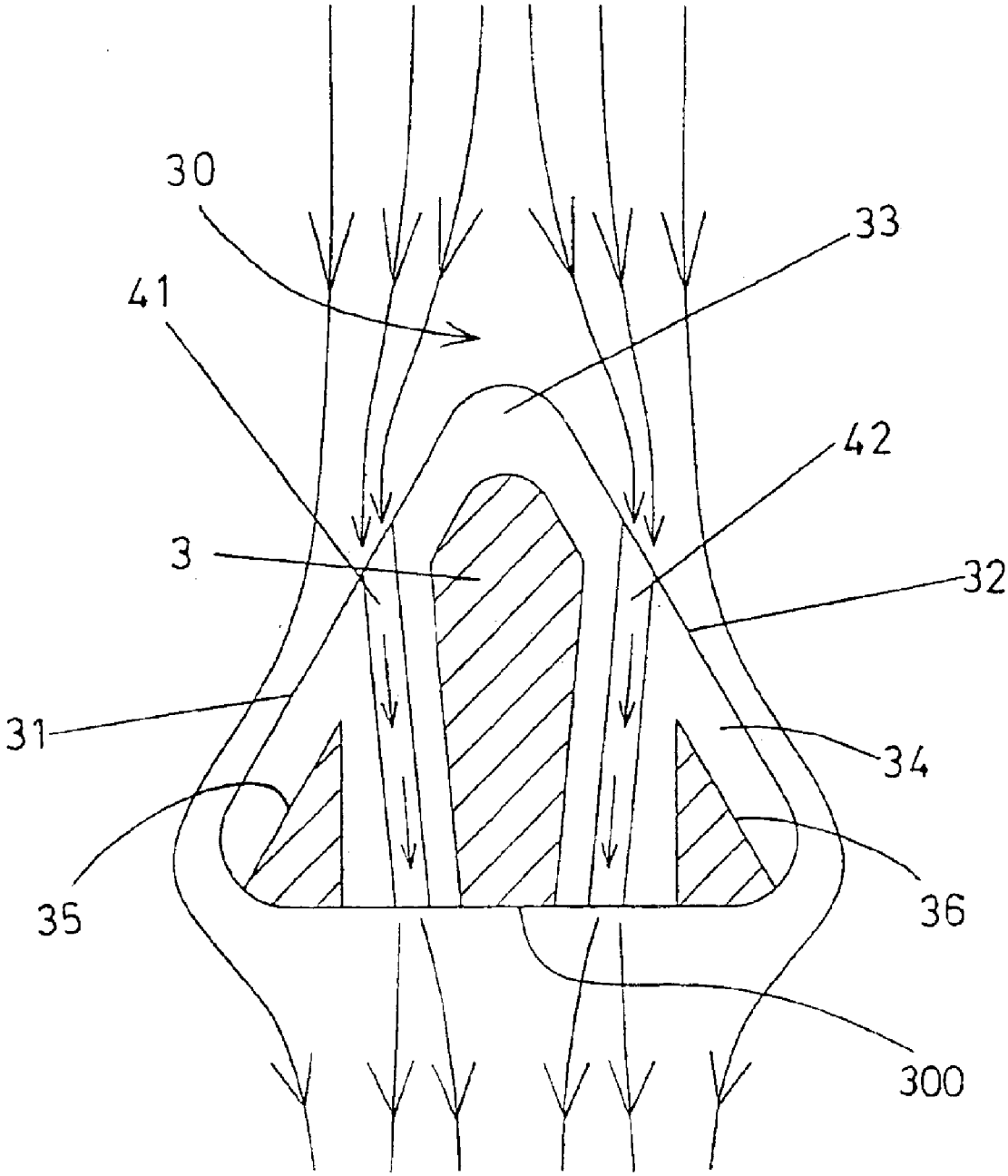
FIG. 3 is a cross sectional view taken along lines 3—3 of FIG. 2.

Referring to the drawings, and especially to FIGS. 1–3, a golf club in accordance with the present invention comprises a handgrip 8, a club head 9, and a club body 3 between the handgrip 8 and the club head 9. The club body 3 normally includes a width or a cross section area gradually reduced from the upper end near the handgrip 8 to the lower end near the club head 9.

The club body 3 includes a longitudinal structure having a pair of inclined surfaces 31, 32 formed in the front portion 30 thereof that faces toward the wind (FIGS. 3, 6, 9) while swinging the club body 3, and having a cusp 33, such as a rounded cusp 33 formed or defined in the front portion of the inclined surfaces 31, 32, or formed in the leading edge of the club body 3.

As best shown in FIG. 3, the club body 3 includes a flat surface 300 formed or defined in the rear portion thereof, and includes a number of air passages 41, 42 formed therein, such as formed between the inclined surfaces 31, 32 and the flat rear surface 300 respectively, for slowing air to flow through the air passages 41, 42 of the club body 3.

The club body 3 may further include one or more depressions 34 formed therein, such as formed in one or more portions thereof, particularly formed in one or more portions of the inclined surfaces 31, 32 thereof for forming or defining one or more reduced segments 40 that have a width or cross section area less than the other portion of the club body 3, and for forming or defining one or more shoulders 43 between the segments 40 and the other portion of the club body 3.

The reduced segments 40 each also includes a pair of inclined surfaces 35, 36 formed in the front portion thereof, and preferably parallel to the inclined surfaces 31, 32 of the club body 3. The formation or the provision of the shoulders 43 in the club body 3 may be used for reducing the vibration or oscillation from the club head 9 toward the hand grip 8.

In operation, as shown in FIG. 3, when striking golf balls with the club body 3 or when swinging the club body 3, some of the air may flow toward the rear portion of the club body 3 via the inclined surfaces 31, 32, or 35, 36 of the club body 3. In addition, the air may also flow through the air passages 41, 42 of the club body 3 in order to reduce eddy current in the rear portion of the club body 3. The golf club may thus be precisely directed toward the predetermined direction, and the golf balls may thus be precisely stricken toward the predetermined direction and position.

Figure 4:
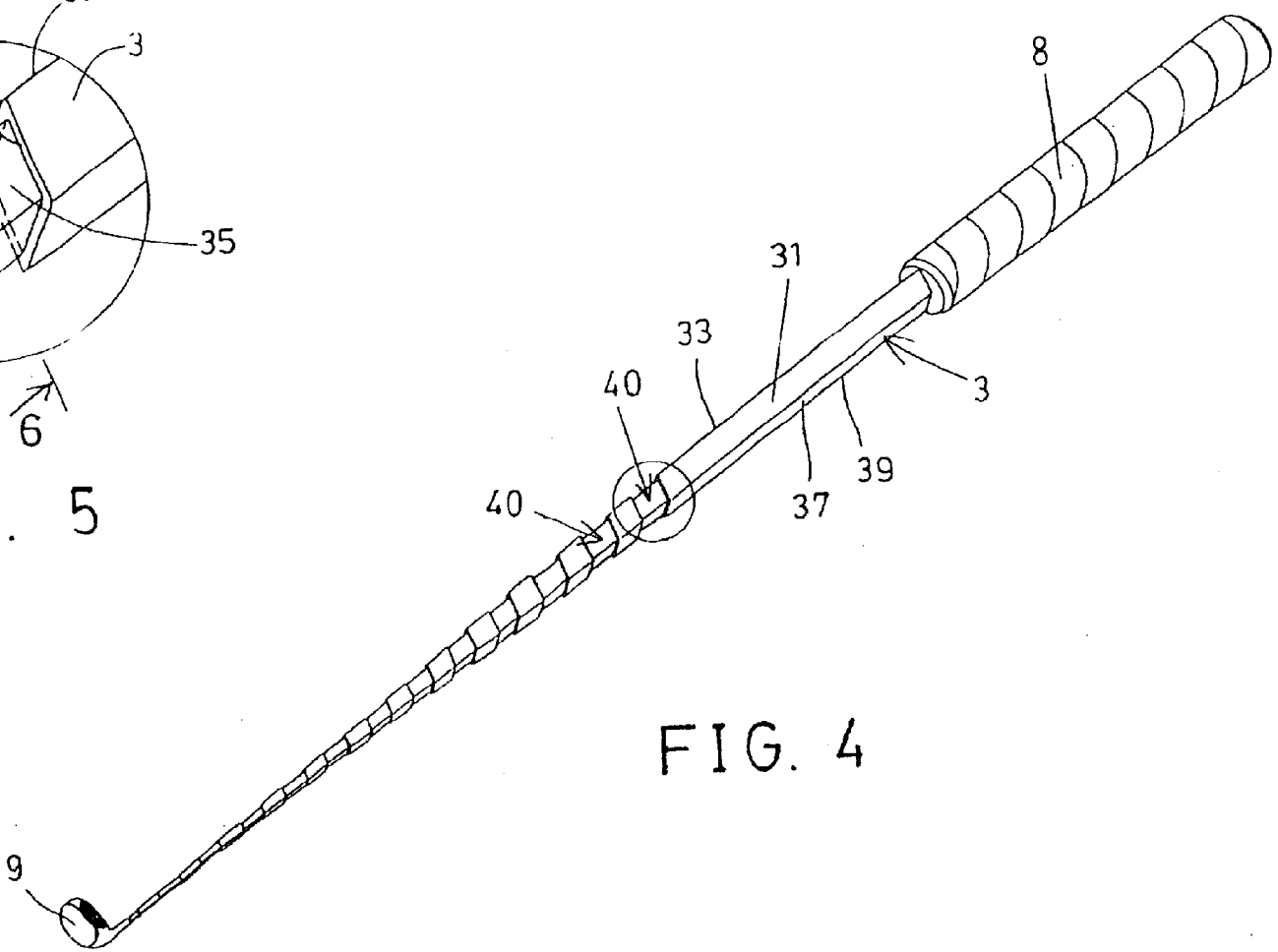
FIG. 4 is a perspective view illustrating another embodiment of the golf club in accordance with the present invention.
Figure 5:
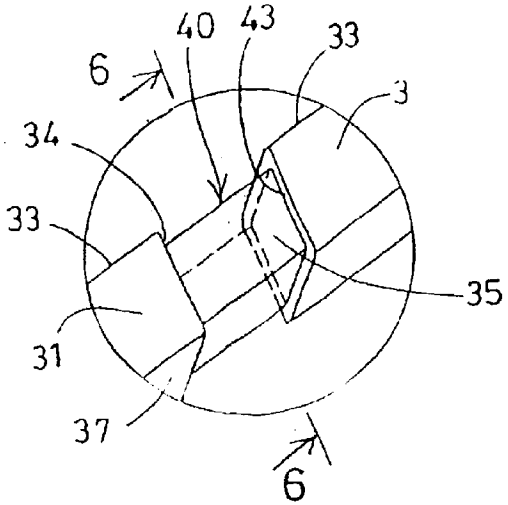
FIG. 5 is an enlarged partial perspective view of the golf club as shown in FIG. 4.
Figure 6:
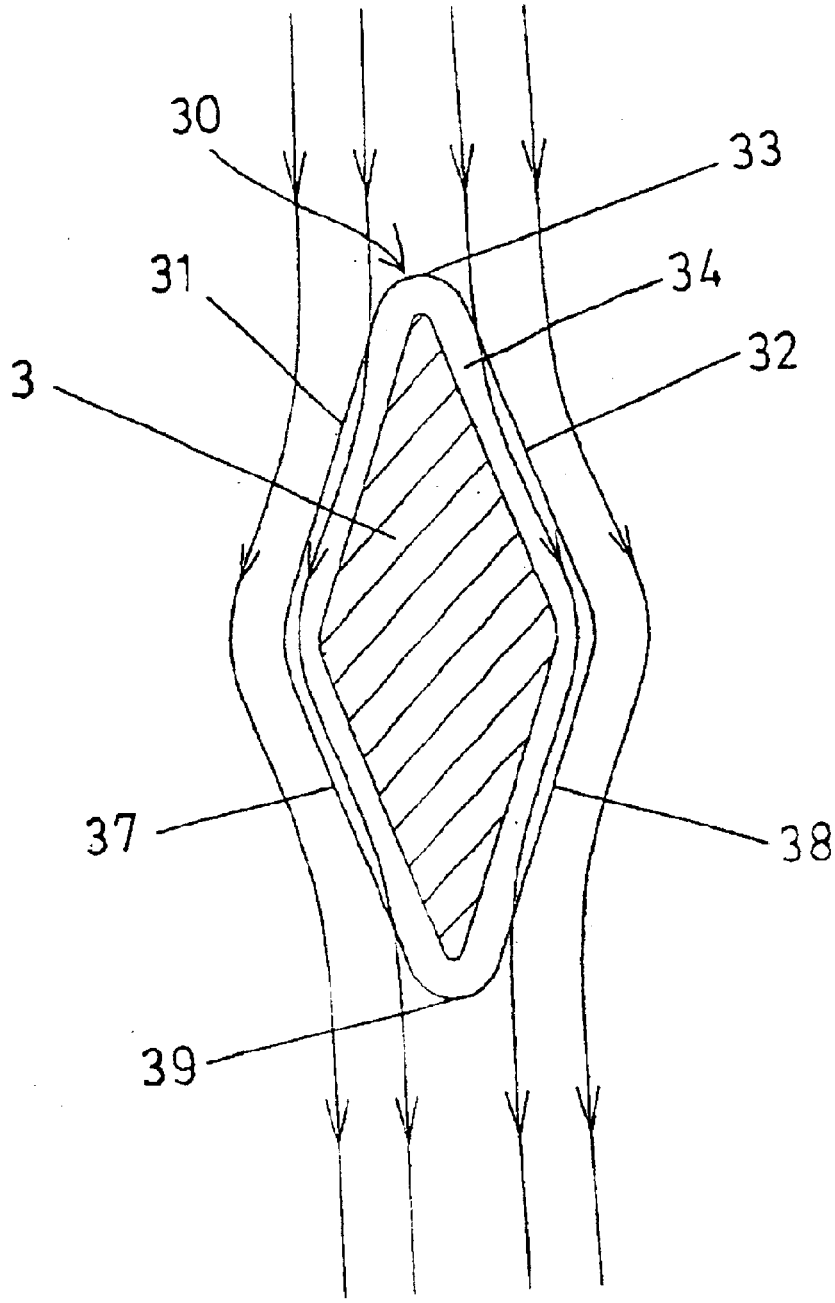
FIG. 6 is a cross sectional view taken along lines 6—6 of FIG. 5.

Referring next to FIGS. 4–6, illustrated is another embodiment of the golf club. In the golf club, without the air passages 41, 42 formed in the club body 3, the club body 3 further includes a pair of inclined surfaces 37, 38 formed in the rear portion thereof that faces away from the wind (FIGS. 6, 9) while swinging the club body 3, and a cusp 39 formed or defined in the rear portion of the inclined surfaces 37, 38, or formed in the rear portion of the club body 3. The air may also fluently or smoothly flow through the club body 3 without generating eddy currents in the rear portion thereof.

Figure 7:
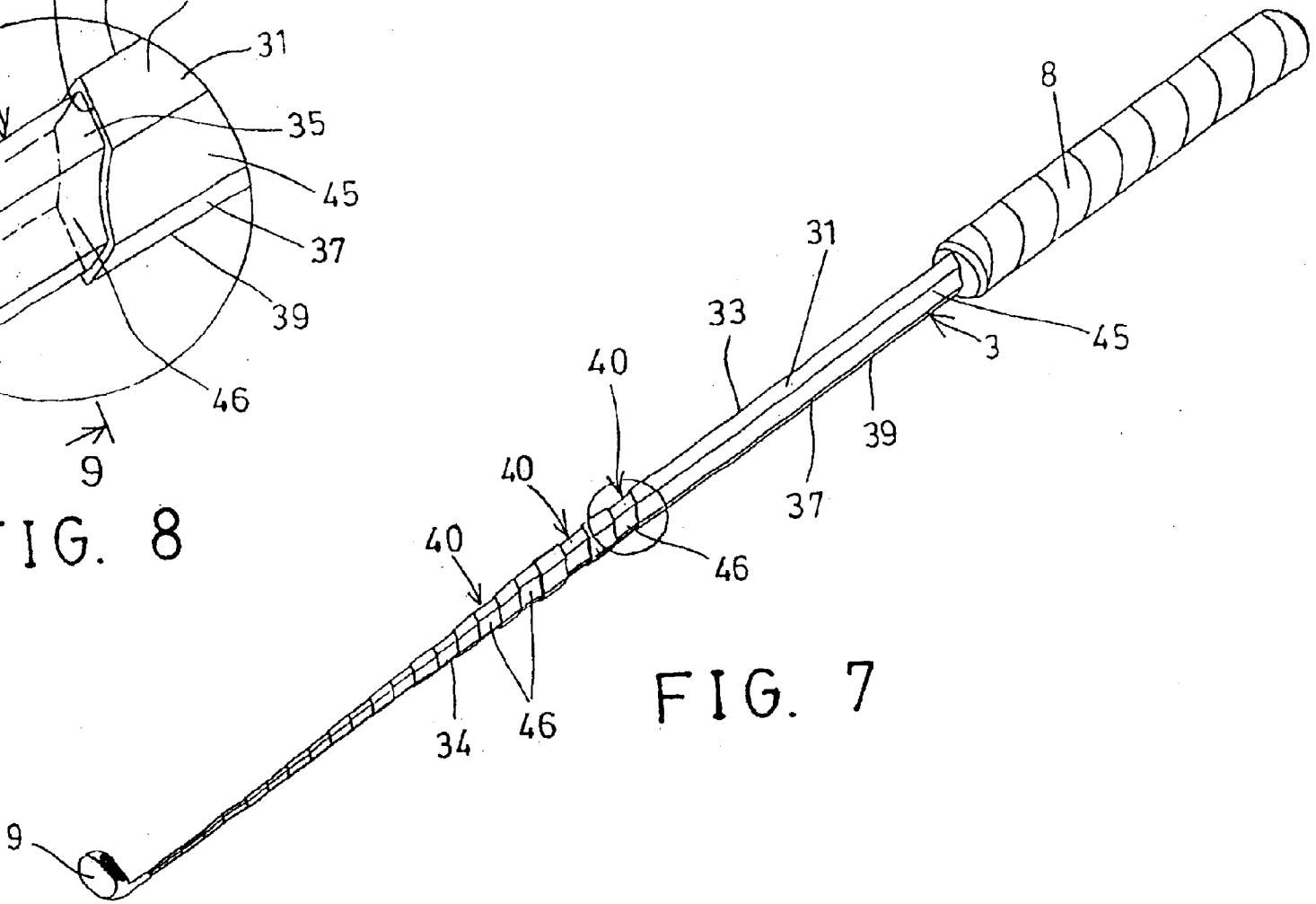
FIG. 7 is a perspective view illustrating a further embodiment of the golf club in accordance with the present invention.
Figure 8:
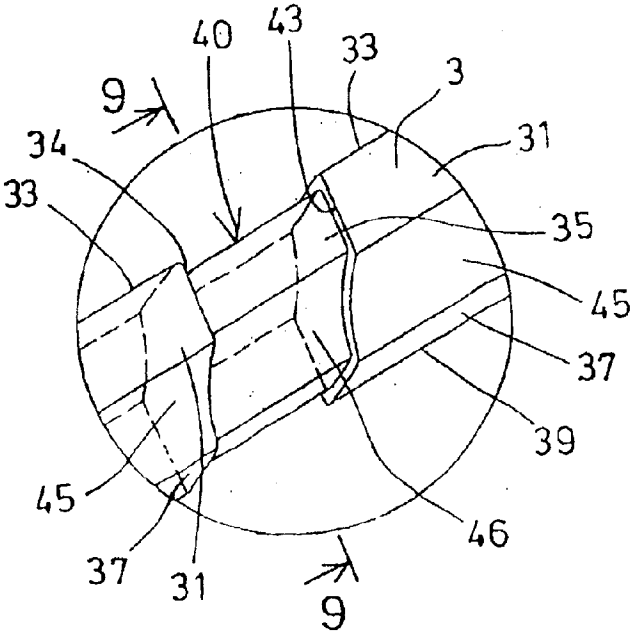
FIG. 8 is an enlarged partial perspective view of the golf club as shown in FIG. 7.
Figure 9:
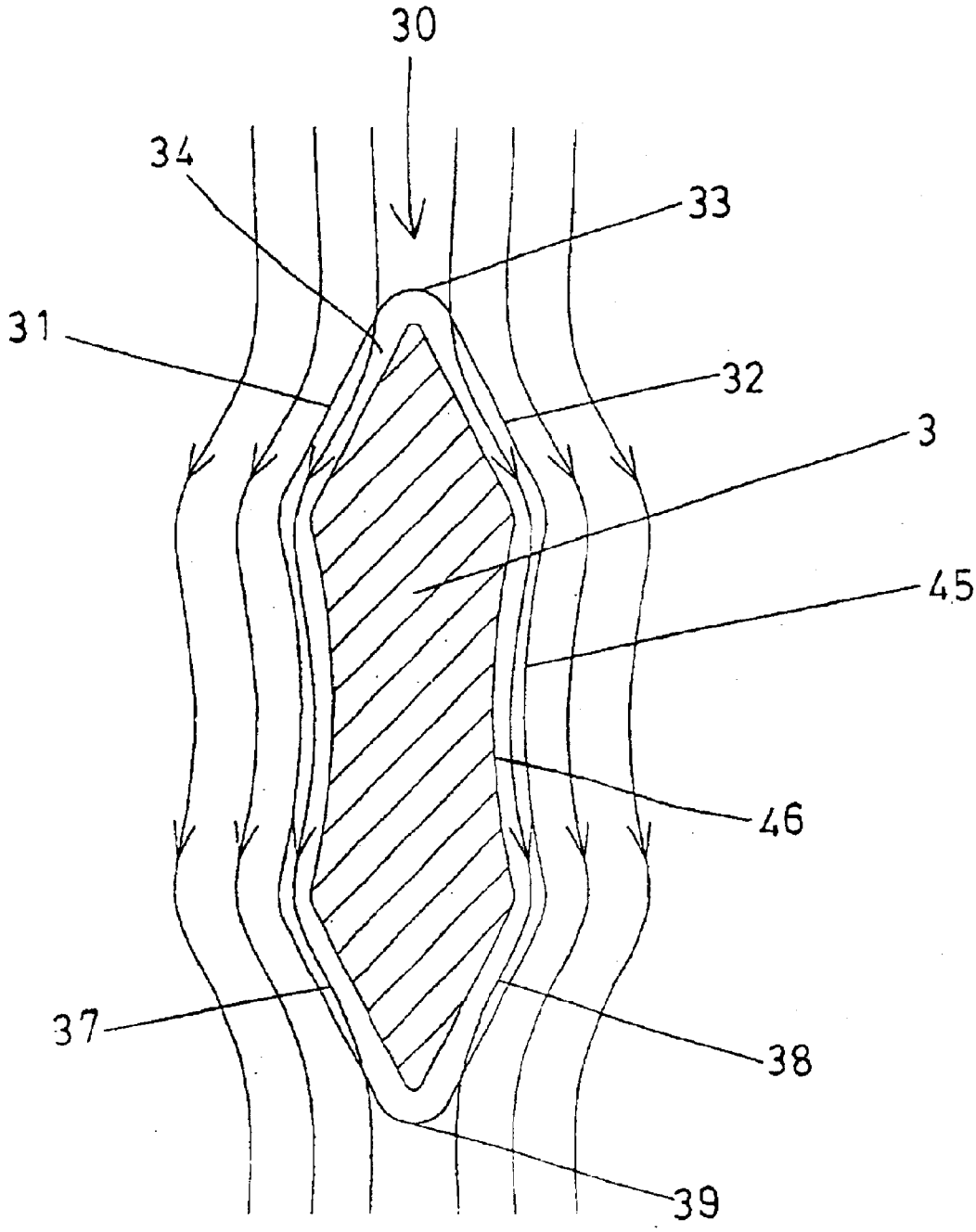
FIG. 9 is a cross sectional view taken along lines 9—9 of FIG. 8.

Referring next to FIGS. 7–9, illustrated is a further embodiment of the golf club. The club body 3 may further include two curved side surfaces 45, 46 formed therein, or formed between the inclined surfaces 31, 32; and 37, 38 respectively. The air may also fluently or smoothly flow through the club body 3 without generating eddy currents in the rear portion thereof.

A middle section 46 is between the front portion 30 and the rear portion. The middle section has two sides. One side is connected between the inclined surface 31 and the inclined surface 37; and the other side is connected between the inclined surface 32 and the inclined surface 38. Each of the two sides is concave into the club body. In a direction from the handgrip 8 to the club head 9, the club body 3 has at least one reduced segment 40 having a smaller size than other portion thereof, and a shoulder 43 encloses a respective end of the reduced segment 40 is formed between each reduced segment 40 and an adjacent portion of the golf club. The reduce segment 40 is reduced from all of one edge of the adjacent portion.

Accordingly, the gold club in accordance with the present invention includes a stabilized airflow or aerodynamic structure for allowing the golf club to be precisely directed toward the predetermined direction, and for allowing the golf balls to be precisely stricken toward the predetermined direction and position.

Although this inventions has been described with a certain degree of particularity, it is to be understood that the present disclosure has been mad by may of example only and that numerous changes in the detailed construction and the combination and arrangement of parts may be resorted to without departing from the spirit and scope of the invention as hereinafter clamed.

What is claimed is:

1. A golf club comprising:

a hand grip;

a club head, and a club body between the hand grip and the club head; and a cross section area of the club body including a front portion having a first inclined and a second inclined surfaces that define a front cusp in a front connection end of said first and said second inclined surfaces;

a rear portion having a third inclined surface and a fourth inclined surface that define a rear cusp at a rear connecting end of the third and fourth inclined surfaces; and a middle section between the front portion and the rear portion; the middle section having two sides; one side being connected between the first inclined surface and the third inclined surface; and the other side being connected between the second inclined surface and the fourth inclined surface; each of the two sides being concave into the club body; and each of the two sides of the middle section having only one concave surface;

wherein in a direction from the handgrip to the club head, the club body has at least one reduced segment having a smaller size than other portion thereof, and a shoulder enclosing a respective end of the reduced segment is formed between each reduced segment and an adjacent portion of the golf club; the reduce segment is wholly reduced from the adjacent portion.

* * * * *